US008162053B2

(12) United States Patent
Green et al.

(10) Patent No.: US 8,162,053 B2
(45) Date of Patent: Apr. 24, 2012

(54) GAS LIFT PLUNGER ASSEMBLY ARRANGEMENT

(75) Inventors: David A. Green, Highlands Ranch, CO (US); Robert E. Bender, Morrison, CO (US)

(73) Assignee: Well Master Corp., Golden, CO (US)

( * ) Notice: Subject to any disclaimer, the term of this patent is extended or adjusted under 35 U.S.C. 154(b) by 370 days.

(21) Appl. No.: 12/460,099

(22) Filed: Jul. 14, 2009

(65) Prior Publication Data

US 2009/0272519 A1 Nov. 5, 2009

Related U.S. Application Data

(63) Continuation-in-part of application No. 12/217,756, filed on Jul. 8, 2008, now Pat. No. 7,793,728, and a continuation-in-part of application No. 11/715,216, filed on Mar. 7, 2007, now Pat. No. 7,748,448, which is a continuation of application No. 11/350,367, filed on Feb. 8, 2006, now Pat. No. 7,395,865.

(60) Provisional application No. 60/593,914, filed on Feb. 24, 2005.

(51) Int. Cl.

| | |
|---|---|
| ***E21B 17/10*** | (2006.01) |
| ***E21B 23/00*** | (2006.01) |
| ***E21B 33/12*** | (2006.01) |

(52) U.S. Cl. ..... 166/277; 166/68; 166/106; 166/153; 166/241.7

(58) Field of Classification Search ..... None
See application file for complete search history.

(56) References Cited

U.S. PATENT DOCUMENTS

| | | | | |
|---|---|---|---|---|
| 6,725,916 | B2 * | 4/2004 | Gray et al. | 166/68.5 |
| 2007/0267189 | A1 * | 11/2007 | Wells | 166/68 |
| 2008/0110617 | A1 * | 5/2008 | Giacomino | 166/250.01 |

* cited by examiner

*Primary Examiner* — Zakiya W Bates
(74) *Attorney, Agent, or Firm* — Dan Halgren

(57) ABSTRACT

A elongated plunger assembly for pressurized, conduit-enclosed travel utilized in recovery of hydrocarbon deposits in a ground penetrating oil or gas well. The plunger comprises an elongated mandrel, a plurality of radially movable curvilinear wear pads circumferentially disposed adjacent each end of the elongated mandrel, a pad-edge retaining housing extending on at least one end of the elongated mandrel to enclosably retain the longitudinally distal end of a circumferential array of wear pads onto the mandrel, and a centrally disposed wear pad securement ring arrangement to permit release of a worn wear pad, replacement of the worn wear pad at an inner longitudinal edge thereof, thus to permit simple field-accessable removal and replacement of any particular "conduit-worn" "wear" pad from the mandrel of the plunger.

18 Claims, 6 Drawing Sheets

GAS LIFT PLUNGER ASSEMBLY ARRANGEMENT

BACKGROUND OF THE INVENTION

1. Field of the Invention

This present invention relates to plunger lift systems for oil and gas wells, and more particularly to a gas lift plunger with an improved assembly arrangement, and is re-filing of Ser. No. 12/313,279, and is a continuation-in-part application of Ser. No. 11/715,216 filed on Mar. 7, 2007 now U.S. Pat. No. 7,748,448 and also of Ser. No. 12/217,756 filed on Jul. 8, 2008 now U.S. Pat. No. 7,793,728, which is a continuation of Ser. No. 11/350,367 filed on Feb. 8, 2006, now U.S. Pat. No. 7,395,865 which was based upon Provisional Patent Application 60/593,914, filed 24 Feb. 2005, each of which is incorporated herein by reference in its entirety.

2. Background Art

Plunger lift systems are artificial lift systems for use in oil and gas wells. U.S. Pat. No. 6,200,103 to Bender, incorporated herein by reference, discloses a gas lift plunger having a cylindrically elongated plunger body, in which the plunger is utilized to promote efficiency in producing oil and gas wells. However, this type of plunger is a solid body type of plunger which is subject to wear as the plunger moves up and down inside the conduits of the lift systems of the oil and gas wells.

The peripheral surface of these plungers provide a pressurized gas seal effect between the travelling plunger and the well's pipe or tubing in which the plunger travels. Re-building or re-conditioning typical worn prior art plungers is a time consuming process, and is often necessarily done in properly equipped repair shops, often far away from where the oil and gas wells are located, where tools, parts and good manufacturing processes are necessary for proper re-building of those worn plungers. Often, these worn plungers, which are expensive pieces of equipment, are typically just thrown away, wasting material and wasting natural resources.

It is an object of the present invention to overcome the disadvantages of the prior art.

It is a further object of the present invention, to provide a plunger assembly which may be repaired easily in the field, with minimal tools and equipment, and without wasting time or device components.

It is a further object of the present invention to permit the simple repair and/or replacement of one or more of "wear pads" on a "tubing-worn" plunger in the field, as one or more replacement pads may be needed, without having to disassemble and re-assemble the entire plunger to do the job.

BRIEF SUMMARY OF THE INVENTION

The present invention comprises a split-pad plunger for use in wells, particularly those wells producing natural gas as the primary hydrocarbon. The split-pad plunger of the present invention is utilized to cyclically travel between the top of the well to the bottom of the well and back, to drive the bulk of the liquid present in its travel conduit, to the surface. The plunger is comprised of an elongated central core or mandrel. The elongated core or mandrel consists of an elongated first half and an elongated second half. Each half is the duplicate of the other half.

The elongated mandrel has a central spine with an annular circumferential ring disposed centrally therearound. Each half of the spine or mandrel has two sets of longitudinally spaced-apart radial arrays of standoffs. A cylindrically shaped "retrieval-neck" is arranged longitudinally outwardly of each distalmost annular array of standoffs. Each retrieval neck has a bore extending therein which receives the distal end of the respective central spine or mandrel. A further embodiment contemplates the retrieval neck and the central spine or mandrel manufactured unitarily from for example, a solid casting.

An arrangement of curved sealing-surface pads are arranged to be supported on the radially outer end of the radially directed standoffs. The curved sealing-surface pads each have a cutout arranged on its longitudinally directed edges. Each cutout slidingly mates with the radially directed standoffs. A radial bias spring is arranged between the central spine or mandrel adjacent each radially directed standoff. The radial bias springs act to radially outwardly bias the curved sealing surface pads against the inner side of the conduit in which the split-pad plunger travels. The outward radial bias of the sealing-surface pads acts to minimize loss of pressure from the lower side of that conduit during its movement therein. The half retrieval-neck has an annular ring on its inner open end, which ring engages a lip on the distal side of the curved sealing-surface pads, and keeps them secured to the central spine or mandrel at each (outer or respective distal) end of that split-pad plunger arrangement.

An arcuately segmented split retainer ring, preferably of semi-circumferential shape, is disposed about the midpoint of the central spine or mandrel, and secures the other or "proximal" longitudinal edge of each curved sealing-surface pad in proper location about the central spine or mandrel. Each split retainer ring itself is held in place around its respective longitudinal mid-portion of the central spine or mandrel by a bolt and elongated manipulable lock washer.

That arcuately segmented split retainer ring thus permits easy assembly and disassembly of the respective curved sealing-surface pads from their respective half portions of the central spine or mandrel, as those curved sealing-surface pads have been worn down by frictional engagement with the inside wall of the tubing or conduit in which the plunger travels. Removal of the bolt and lock washer from the arcuately segmented split retainer ring facilitates the simple removal of the retrieval neck from the distal end of each respective curved surface pad. This thus permits the curved surface pads to be removed from their engagement with the radial bias springs, and replaced by new pads right at the "field" site.

The invention thus comprises a elongated plunger assembly for pressurized, conduit-enclosed travel utilized in recovery of hydrocarbon deposits in a ground penetrating oil or gas well, comprising: an elongated mandrel, a plurality of radially movable curvilinear pads circumferentially disposed adjacent each end of the elongated mandrel, a pad-edge retaining housing extending on each end of the elongated mandrel to enclosably retain the longitudinally distal end of the pads onto the mandrel, and a centrally disposed pad securement ring arrangement to permit release, and permit re-securement of an axially-inner longitudinal edge of one or more wear pads, thus to permit simple removal and replacement of at least one conduit-worn "wear" pad and/or "tired" bias springs from the mandrel. The curvilinear wear pads are preferably biased radially outwardly by a plurality of the bias spring members extending radially outwardly from the body of the elongated mandrel. The centrally disposed pad securement ring arrangement may be secured to a central ring-ridge by, for example, a releasably controlled bolt member therethrough. A single bolt member preferably secures a semi-circular securement ring to the central ring-ridge. The semi-circular securement ring preferably has an elongated slot for receipt of an elongated lock washer member. The elongated lock washer has, for example, one or more bendable tabs thereon to releasably secure the bolt thereby.

The invention also comprises method of replacing worn arcuate outer pads from a plunger assembly used in an oil or gas recovery well operation, comprising one or more of the following steps including: arranging a set of biased outwardly, elongated arcuate pads on an elongated oil/gas well plunger mandrel; securing the respective longitudinally ends of one annular set of the outer elongated arcuate pads to the mandrel by a retrieval neck member screwed onto an end of the mandrel; securing the inwardly directed ends of the one annular set of the outer elongated arcuate pads to the mandrel by a split ring releasably bolted to the mandrel.

The split ring preferably comprises a pair of semi-circumferential bands releasably attachable to the mandrel each by a bendable, field accessable lock washer.

The elongated plunger assembly may have a releasable lock washer as a visable "spring-capacity" indicator notch thereon to indicator to field repair personnel what capacity springs are being utilized to bias each wear pad outwardly. The wear pad in one preferred embodiment, may have a spiral array of grooves thereon to indicate levels of wear thereon, acting as a "wear indicator" on the pad. Signal generated sensors, such as "circuit-completion" contacts or rf signal generators through a proper buried circuit, or conspicuous visual indicators may also be embedded within the pads or grooves to indicate pad wear. The grooves in the pads also cause the plunger to rotate about its longitudinal axis, to promote "even" wear on those wear pads, (especially in wells with inclined tubing), and also to generate turbulence during the plunger's travels within the well's tubing.

The invention also may comprise a wear pad retaining housing which comprises a cylindrically shaped shoe on a lower end of the mandrel. The shoe on the lower end of the mandrel may has an array of spiraled flutes thereon to effect rotation of the plunger during its travels in a well. The wear pad retaining housing on the lower end of the mandrel may have an electronic sensor enclosure therein to protect and replaceably enclose a electronic sensor monitoring and control mechanism therein. The releasable lock washer preferably has at least one bendable tab thereon, to releasably secure the bolt thereby. The releasable lock washer preferably has a visable "spring-capacity" indicator thereon to indicate to field repair personnel the "stiffness-capacity" of the springs being utilized to bias each wear pad outwardly. At least one of the wear pads may have a spiral array of grooves thereon to indicate levels of wear thereon, to rotate the plunger and/or and to generate turbulence during the plunger's travels within the well's tubing.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
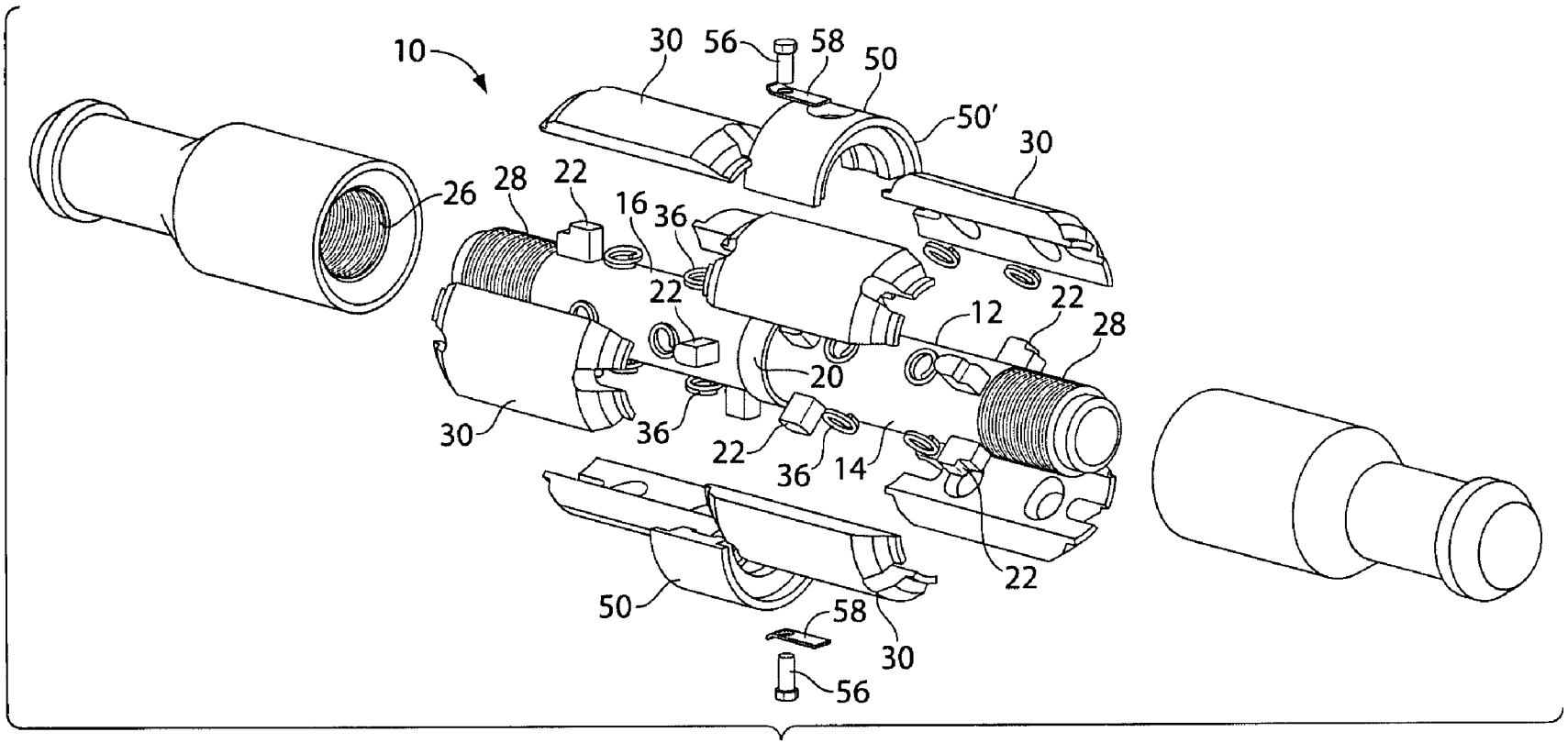
FIG. 1 is an "exploded" perspective view of the split pad-plunger assembly showing details of the construction according to the principles of the present invention.
Figure 2:
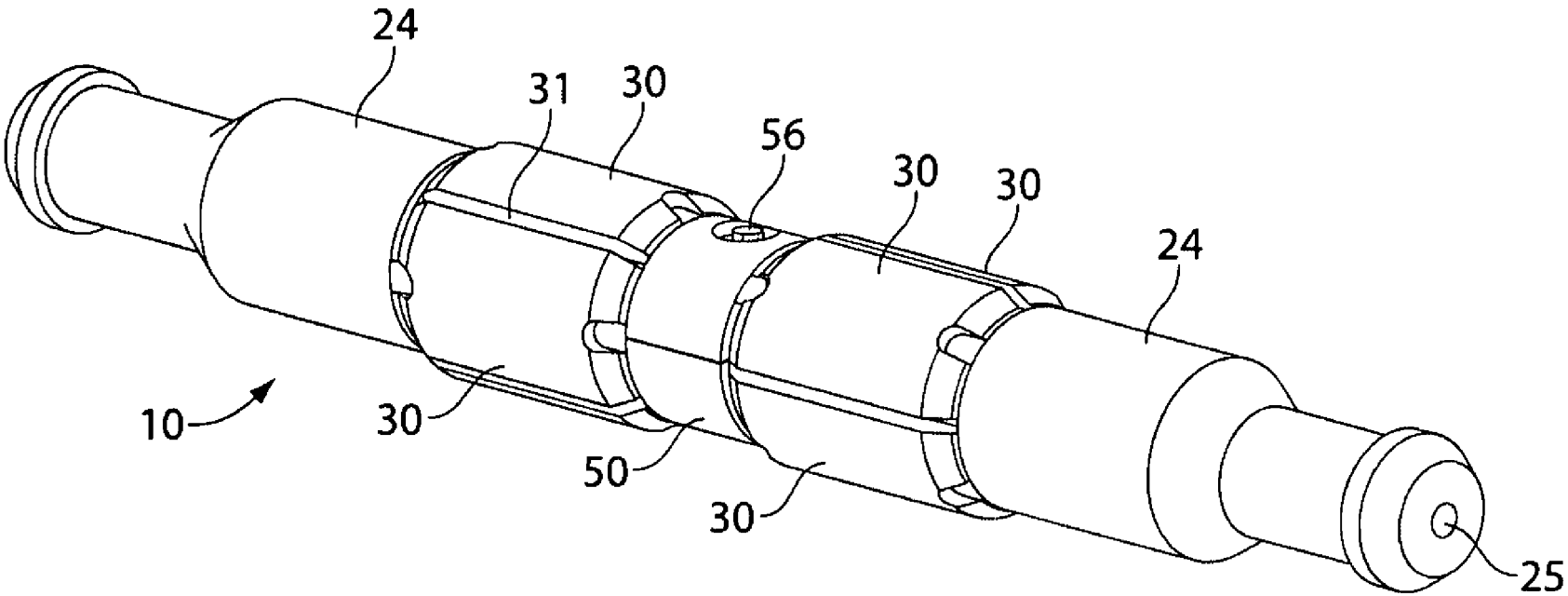
FIG. 2 is a perspective view of the assembly shown at FIG. 1 in its finished and assembled form.

Referring to the drawings in detail, and particularly to FIG. 1, there is shown in an "exploded" view, the present invention which comprises a split-pad plunger assembly 10 for use in wells, particularly those wells producing natural gas as the primary hydrocarbon. The split-pad plunger assembly 10 of the present invention, shown in an assembled embodiment in FIG. 2, is utilized to cyclically travel between the top of the well to the bottom of the well and back, to drive the bulk of the liquid present in its travel conduit, to the surface. The plunger assembly 10 is comprised of an elongated central core or mandrel 12, shown in FIGS. 1 and 3. The elongated core or mandrel 12 consists of an elongated first half 14 and an elongated second half 16. Each half 14 and 16 at least in this preferred embodiment, is preferably the duplicate of the other half 16 and 14.

Figure 3:
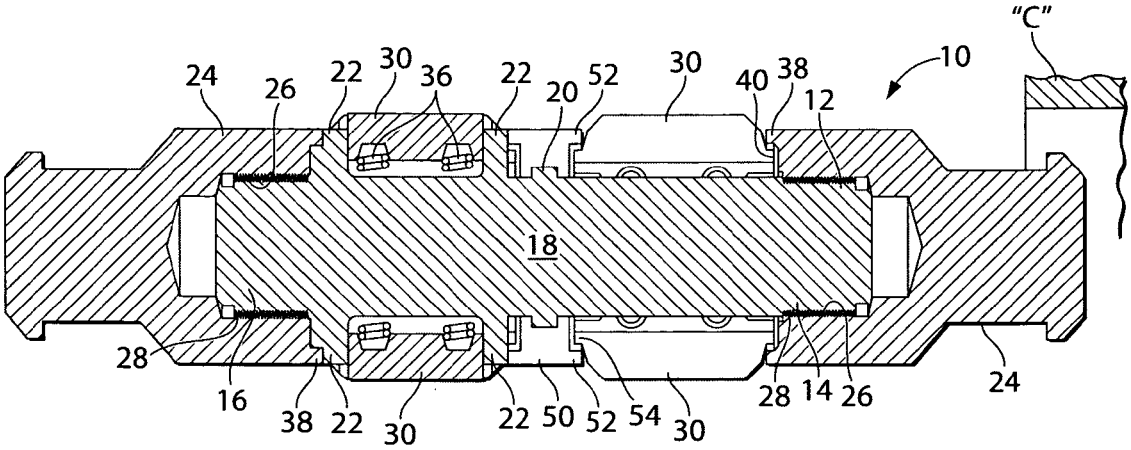
FIG. 3 is a sectional view taken longitudinally along the plunger's longitudinal axis.
Figure 4:
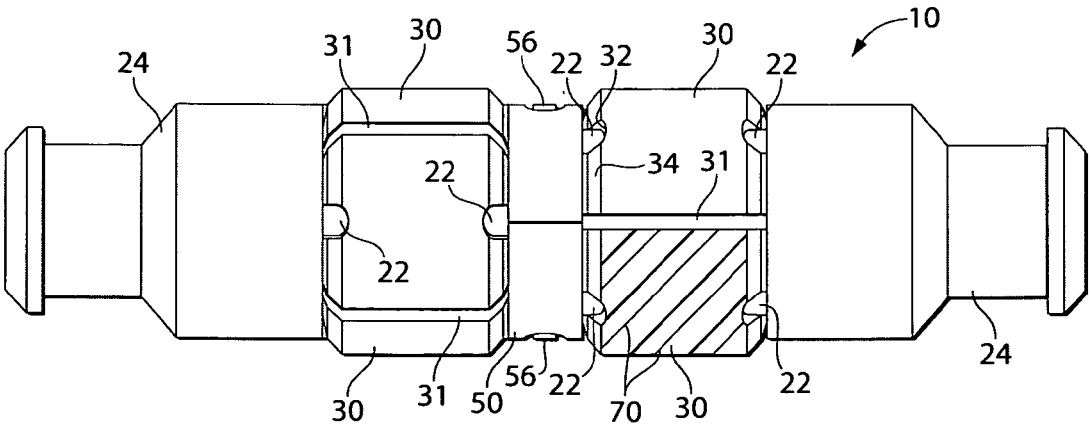
FIG. 4 is a side elevational view of the plunger shown in FIG. 2.
Figure 4A:
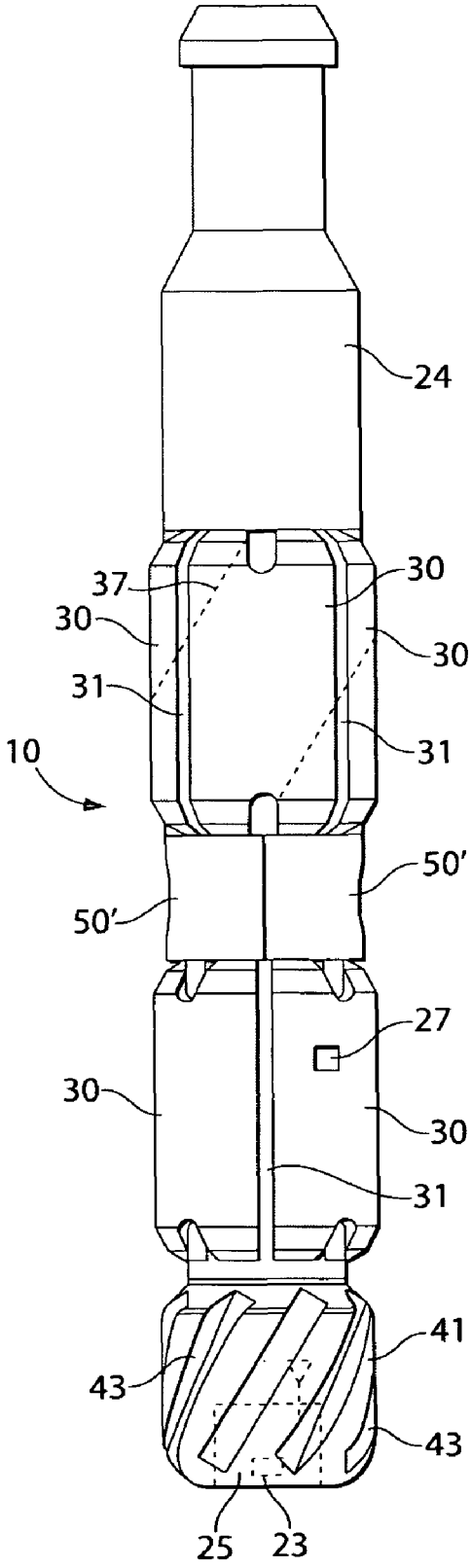
FIG. 4A is a side elevational view of the plunger in an alternative embodiment, with a fluted shoe on its lower end.
Figure 5:
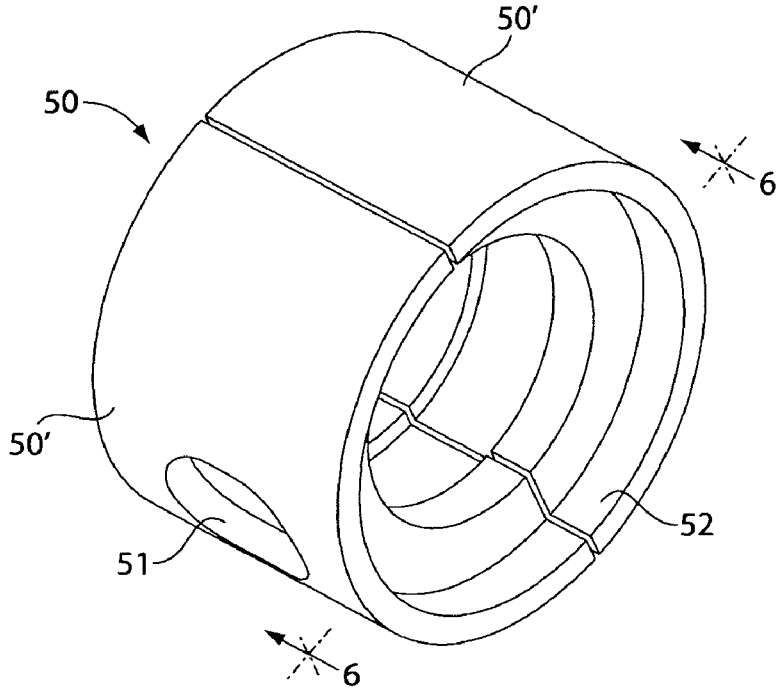
FIG. 5 is a perspective view of the split ring arrangement utilized to support the outer wear pads.

The elongated mandrel 12 has a mid-portion 18 with an annular circumferential securement ring ridge 20 disposed centrally therearound. Each half 14 and 16 of the spine or mandrel 12 has two sets of longitudinally spaced-apart radial arrays of supports 22. A cylindrically shaped "retrieval-neck" 24 is arranged longitudinally outwardly of each distalmost annular array of supports 22. Each retrieval neck 24 may have a bore 26 extending therein which threadedly receives the screw threaded distal end 28 of the respective central spine or mandrel 12, as is seen in FIG. 3, and is represented in FIG. 1. In a further embodiment, not shown for ease of viewing, one or both of the retrieval necks 24 are part of a solid casting with the mandrel 18, and are irremovable therefrom. In yet a further embodiment of the plunger assembly 10, one of the retrieval necks 24, herein designated as the "lower" end, for example purposes only, has a protective sensor enclosure 25, shown in FIG. 2, for safely and replaceably enclosing proper wireless communicative electronic sensors and alarms 23, for sensing well casing pressure, time, distance, fluid composition, viscosity, chemical makeup and the like, and also maintaining report/control functions and/or an antennae for the plunger assembly 10. Such sensors 23 may be in proper communication with embedded sensors 27 embedded within an array of wear pads 30, as represented in FIG. 4A. A further embodiment of the lower retainer ring 24 is represented in FIG. 4A, wherein a cylindrically shaped "shoe" 41 is utilized to secure the longitudinally outer end of one set of wear pads 30, the shoe 41 having a plurality of spiraled flutes 43 therein to further effect rotation of the plunger 10 in its vertical/inclined travels within a well.

Relative to the "wear functions" of the plunger assembly 10, an arrangement of for example, four curved sealing-surface pads 30 are circumferentially arranged about each mandrel half 14 and 16, as represented in FIGS. 2 and 3, so as to be radiatively slidingly supported adjacent the radially outer end of each radially directed support 22. The curved sealing-surface pads 30 each have a cutout 32 arranged on its longitudinally directed edges 34. Each cutout 32 slidingly mates with the radially directed support 22. A radial bias spring 36 is arranged between the central spine or mandrel 12 adjacent each radially directed support 22. The radial bias springs 36 act to radially outwardly bias the curved sealing surface pads 30 against the inner side of the conduit "C" in which the split-pad plunger 10 travels. The outward radial bias of the sealing-surface pads 30 acts to minimize loss of pressure from the lower side of that conduit "C" during movement of the plunger 10 therein. One or more wear pad 30 may have a plurality of spiral grooves 70 thereon as shown in FIG. 4, to indicate wear patterns on the pads 30, to generate rotation of the plunger 10 about its longitudinal axis (for even wear on the pads 30), and/or to stimulate turbulence within the well's tubing "C" during the plunger's travels therein. Each set of circumferentially adjacent pads 30 on each respective end 14 and 16 of the mandrel 12 have gaps 31 between one another, as may be seen in FIGS. 1, 4 and 4A. The gaps 31 are not in axial alignment with one another between the pads 30 on each end of the mandrel 12, as also may be seen in FIGS. 1, 4 and 4A. Those pads 30, may in a further embodiment, be of a "spiral" configuration 37 (e.g. curvilinear parallelogram), as represented o FIG. 4A, to facilitate better wear patterns and rotational motion to the plunger assembly 10.

Each half retrieval-neck 24 has an annular ring 38 on its inner open end, as represented in FIG. 3. This ring 38 engages a lip 40 on the distal side of the curved sealing-surface pads 30, and keeps them secured to the central spine or mandrel 12 at each (outer or respective distal) end of that split-pad plunger 10, as is represented in FIG. 3.

Figure 6:
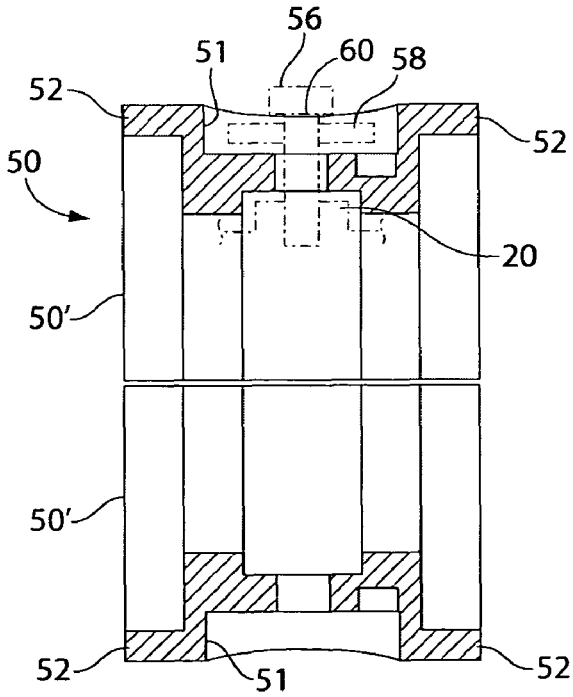
FIG. 6 is a cross-sectional view of the split rings taken along the lines 6-6 in FIG. 5.

An arcuately segmented split retainer ring 50, preferably of semi-circumferential shape, as represented in FIGS. 1-6, is disposed about the mid-point of the central spine or mandrel 12, and has an annular lip 52 which secures the other or "proximal" longitudinal edge 54 of each curved sealing-surface pad 30 in proper location about the central spine or mandrel 12. Each set of split retainer rings 50 is held in place around its respective longitudinal mid-portion of the central spine or mandrel 12 by a bolt 56 extending therethrough, with an elongated, adjustable lock washer 58, as represented in an "exploded" configuration in FIG. 1. Each set of split rings 50 has an elongated slot 51 in each ring 50', as represented in FIG. 6.

Figure 7:
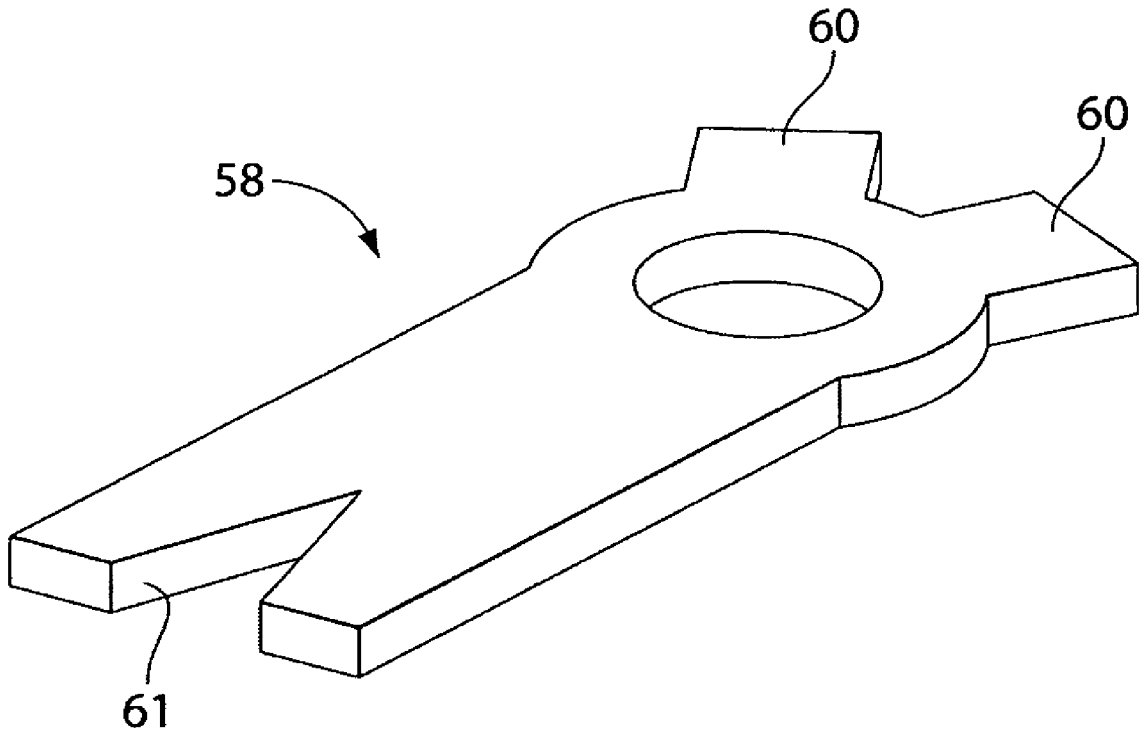
FIG. 7 is a perspective view of the lock washer utilized to lock the securement bolt in place in one of the split rings.

The adjustable lock washer 58, shown best in FIG. 7, receives the bolt 56, as is represented in FIG. 1 and as is represented in phantom in FIG. 6. The washer 58 has at least one movable lock tab 60 thereon, as represented in FIG. 7, for easy manipulation at a "field" repair site. The washer 58 may also have spring-strength indicia thereon, as for example, a field personnel-visable indicator notch 61 on its periphery, as shown in FIG. 7, to indicate for example, what capacity (weak or standard) inner spring 36 is being utilized beneath each wear pad 30. If there is no notch 61, the spring 36 is for example, a "standard" strength spring 36; and for example, if there is a notch 61, then a "weak" spring 61 for example, is visually indicated. The bolt 56 is screwed into the longitudinal load bearing central ring 20 on the central portion of the mandrel 12 through the hole in the elongated lock washer 58. The tab(s) 60 on the washer 58 is/are bendable outwardly to lock against flats on the head of the bolt 56 in place until it is necessary to remove the conduit-worn wear pads 30 and replace them with fresh (full dimensioned, conduit pressure ensuring) wear pads 30. Thus, simple "in-the-field" unbending of the tab(s) 60 from its/their retention position against the hex head of the bolt 56 in the respective split rings 50, permits that bolt 56 to be easily backed-out of its/their threaded hole/s in the mandrel 12 into which it/they was/were screwed, and thus permitting the simple "field" removal of each ring 50' of the set of spilt rings 50 without unnecessary, complicated tools or equipment otherwise necessary by the prior art plungers for their repair.

That arcuately segmented split retainer ring 50 thus permits easy assembly and disassembly of the respective curved sealing-surface wear pads 30 from their respective half portions of the central spine or mandrel 12, as those curved sealing-surface pads 30 have been worn down by frictional engagement with the inside wall of the tubing or conduit "C" in which the plunger 10 travels. Removal of the bolt 56 and lock washer 58 from each arcuately segmented split retainer ring 50' will permit the removal of its retrieval neck 24 from the other longitudinal side of each respective curved surface pad 30, and then permits those curved surface pads 30 to be lifted from their engagement with the radial bias springs 36, and replaced at the "field" site.

We claim:

1. An elongated plunger assembly for pressurized, conduit-enclosed travel utilized in recovery of hydrocarbon deposits in a ground penetrating oil or gas well, comprising:

an elongated mandrel;

a plurality of replaceable, radially movable curvilinear wear pads circumferentially disposed adjacent each end of the elongated mandrel;

a wear pad edge-retaining housing extending on each end of the elongated mandrel to enclosably retain the longitudinally distal end of the replaceable wear pads onto the mandrel of the plunger assembly;

a centrally disposed pad securement ring arrangement to simultaneously secure and permit release of an inner longitudinal edge of at least one wear pad from the plurality thereof, thus to permit simple removal and replacement of any particular conduit-worn wear pad from the mandrel of the plunger, wherein the curvilinear wear pads are biased radially outwardly by a plurality of spring members extending radially outwardly from the body of the elongated mandrel, wherein the centrally disposed pad securement ring arrangement is secured to a central ring-ridge by a releasably controlled bolt member therethrough, wherein a single bolt member secures a semi-circular securement ring to the central ring-ridge, and wherein the semi-circular securement ring has a biasable lock washer receiving opening for receipt of a releasable lock washer member therein.

2. The elongated plunger assembly as recited in claim 1, wherein the releasable lock washer has spring strength indicia arranged thereon.

3. The elongated plunger assembly as recited in claim 1, wherein the curvilinear wear pads are biased radially outwardly by a plurality of spring members extending radially outwardly from the body of the elongated mandrel.

4. The elongated plunger assembly as recited in claim 1, wherein the wear pad retaining housing comprises a cylindrically shaped shoe on a lower end of the mandrel.

5. The elongated plunger assembly as recited in claim 4, wherein the shoe on the lower end of the mandrel has an array of spiraled flutes thereon to effect rotation of the plunger during its travels in a well.

6. The elongated plunger assembly as recited in claim 4, wherein the releasable lock washer has a visable spring-capacity indicator thereon to indicate to field repair personnel the stiffness-capacity of the springs being utilized to bias each wear pad outwardly.

7. The elongated plunger assembly as recited in claim 1, wherein the wear pad retaining housing on the lower end of the mandrel has an electronic sensor enclosure therein to protect and replaceably enclose a electronic sensor monitoring and control mechanism therein.

8. The elongated plunger assembly as recited in claim 7, wherein the sensor in the pad retaining housing is in communication with a sensor embedded within a wear pad attached to the mandrel of the plunger.

9. The elongated plunger assembly as recited in claim 1, wherein the wear pad is of a curvilinear parallelogram shape to facilitate even wear thereof.

10. An elongated plunger assembly for pressurized, conduit-enclosed travel utilized in recovery of hydrocarbon deposits in a ground penetrating oil or gas well, comprising:

an elongated mandrel;

a first and a second annular array of replaceable, radially movable curvilinear wear pads disposed on the elongated mandrel, and spaced longitudinally apart from one another;

a wear pad-edge retaining housing extending on each end of the elongated mandrel to enclosably retain the longitudinally distal end of the pads onto the mandrel; and a centrally disposed pad securement ring arrangement to simultaneously secure and permit release of an axially-inner longitudinal edge of at least one wear pad from the plurality thereof, thus to permit simple removal and replacement of any particular conduit-worn wear pad from the mandrel of the plunger.

11. The elongated plunger assembly as recited in claim 10, wherein the centrally disposed wear pad securement ring arrangement is secured to a central ring-ridge by a releasably controlled bolt member therethrough.

12. The elongated plunger assembly as recited in claim 11, wherein the semi-circular securement ring has a lock washer receiving opening for receipt of a releasable lock washer member.

13. The elongated plunger assembly as recited in claim 12, wherein the releasable lock washer has at least one bendable tab thereon, to releasably secure the bolt thereby.

14. The elongated plunger assembly as recited in claim 10, wherein a single bolt member secures a semi-circular securement ring to the central ring-ridge.

15. The elongated plunger assembly as recited in claim 10, wherein at least one of the wear pads has a spiral array of grooves thereon to indicate levels of wear thereon, to facilitate rotation of the plunger, and to generate turbulence during the plunger's travels within the well's tubing.

16. A method of replacing at least one worn arcuate outer wear pad from a plunger assembly used in an oil or gas recovery well operation, comprising:

arranging a first circumferential set and a second circumferential set of biased outwardly, elongated, arcuate wear pads on an elongated oil/gas well plunger mandrel, each of the circumferential sets being disposed longitudinally apart from one another on the mandrel;

securing the respective longitudinal ends of one annular set of the outer elongated arcuate wear pads to the mandrel by a retrieval neck member screwed onto an end of the mandrel;

securing the inwardly directed ends of the one annular set of the outer elongated arcuate wear pads to the mandrel by a wear pad securing split ring releasably bolted to the mandrel.

17. The method as recited in claim 16, wherein the wear pad securing split ring comprises a pair of semi-circumferential bands releasably attachable to the mandrel each by a bendable, field-accessable lock washer.

18. The method as recited in claim 16, wherein the semi-circumferential bands are secured to a load bearing annular ridge of the mandrel.

* * * * *